United States Patent [19]

Holzer

[11] 4,363,459

[45] Dec. 14, 1982

[54] ADJUSTABLE WALL MOUNTED BRACKET

[75] Inventor: Joseph C. Holzer, Liverpool, N.Y.

[73] Assignee: Joanna Western Mills Company, Chicago, Ill.

[21] Appl. No.: 213,397

[22] Filed: Dec. 5, 1980

[51] Int. Cl.[3] ..... A47M 1/10

[52] U.S. Cl. ..... 248/265; 248/257

[58] Field of Search ..... 248/262, 265, 261, 263, 248/254, 257; 100/178 B

[56] References Cited

U.S. PATENT DOCUMENTS

| | | | |
|---|---|---|---|
| 1,845,857 | 2/1932 | Ward . | |
| 2,083,334 | 6/1937 | Lorentzen | 156/17 |
| 2,429,446 | 10/1947 | Albrecht | 248/264 |
| 2,660,237 | 11/1953 | Bopp | 160/34 |
| 2,720,373 | 10/1955 | Bell | 248/262 |
| 2,966,696 | 1/1961 | Young | 16/94 |
| 3,028,910 | 4/1962 | Bopp et al. | 160/172 |
| 3,061,005 | 10/1962 | Bopp et al. | 160/176 |
| 3,247,893 | 4/1966 | Ford | 248/262 X |
| 3,299,943 | 1/1967 | Poe | 160/176 |
| 3,463,217 | 8/1969 | Assael | 160/39 |
| 4,079,770 | 3/1978 | Woodle | 160/19 |
| 4,179,091 | 12/1979 | Bidney | 248/265 |
| 4,305,562 | 12/1981 | Bellinger | 248/263 |

*Primary Examiner*—J. Franklin Foss

*Attorney, Agent, or Firm*—Bean, Kauffman & Bean

[57] ABSTRACT

A bracket assembly for vertical venetian blinds having a horizontally disposed fixed support member, a pair of side rails vertically extending from the longitudinal side edges of the fixed support member, a mounting element vertically projecting from one end of the support member, a longitudinally extending slot between the side rails extending from adjacent the one end to a transverse end of the support member, a break-away apertured tab closing the slot at the transverse end, an apertured extension arm slidably mounted on the support member within the confines of the side rails and a spring clip secured to the extension arm in all positions thereof for releasably securing a vertical venetian blind trackway thereto.

8 Claims, 5 Drawing Figures

ADJUSTABLE WALL MOUNTED BRACKET

SUMMARY OF THE INVENTION

The present invention relates to adjustable brackets and more particularly, to a wall mounted bracket assembly for adjustably supporting the trackway of vertical blind systems or the like.

The bracket assembly of the present invention is characterized by means formed as an integral part of a fixed bracket member, which permits a movable extension arm and trackway mounting spring clip to assume a stable and secure position at virtually any location between positions of maximum and minimum extension of the extension arm with respect to the fixed bracket member. Such means includes a multi-functioning break-away tab which bridges one end of a through, extension arm adjustment slot provided in the bracket member and adds rigidity or rib strength to the bracket member in positions of the extension arm at or near the maximum limit of its range. In the minimum position of extension of the extension arm with respect to the bracket member, the tab is simply broken away and discarded to prevent unsightly projection thereof forwardly beyond the trackway to be mounted. In certain mid-range positions of extension, the tab is broken away and then employed as a shim or washer to span the distance between a plane defined by the mating or engaging surfaces of the bracket and the spring clip member and a parallel plane defined by the mating or engaging surfaces of the bracket member and the extension arm within the area of projection of the extension arm. In this manner, the spring clip and thus the blind trackway mounted thereby remain at all times in planes parallel to the plane of the mating surfaces of the bracket member and the extension arm. Any tendency of the trackway to cant or tilt is thereby effectively eliminated.

Essentially then, the present invention provides an adjustable bracket assembly for the trackway of vertical blinds, comprising a fixed bracket member containing an elongated, longitudinally extending slot closed at one end by an apertured break-away tab; an extension arm in the form of a plate having threaded mounting apertures and supported by the bracket member for sliding or adjusting movements relative thereto in a direction lengthwise of the slot; and an apertured spring clip for releasably securing a trackway in a selectively adjusted position, wherein the clip is fixed by a mounting screw to the extension arm in all positions of extension thereof with respect to the bracket member.

BRIEF DESCRIPTION OF THE DRAWINGS

For a fuller understanding of the present invention, reference should now be made to the following detailed description thereof taken in conjunction with the accompanying drawings, wherein.

DETAILED DESCRIPTION OF THE PREFERRED EMBODIMENT

Figure 1:
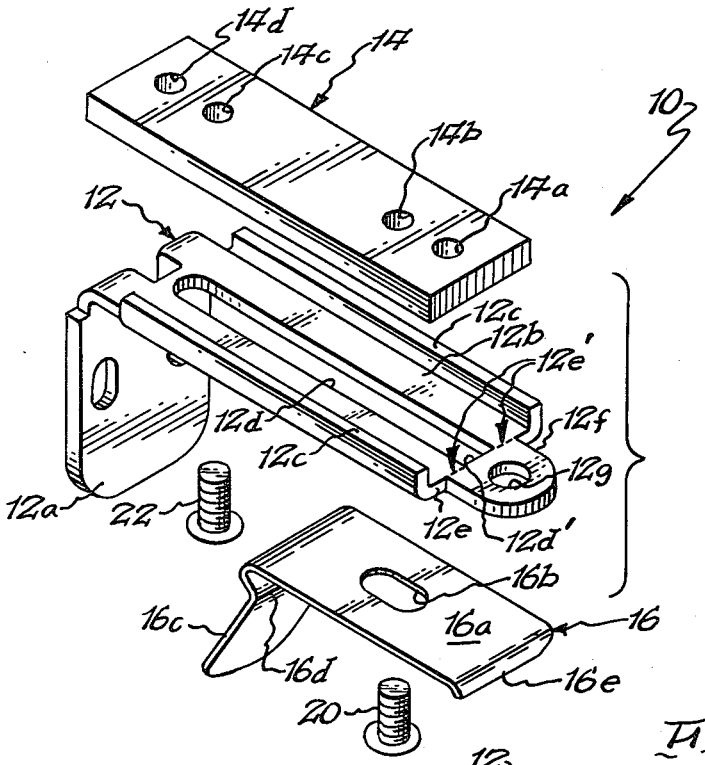
FIG. 1 is an exploded perspective view of the bracket assembly of the invention.

Referring to the drawings, the bracket assembly of the present invention is generally depicted at 10 and is shown as comprising a wall affixed or otherwise supported stationary bracket member 12; an extension arm 14 supported by the bracket member for slidable movement with respect thereto; a suitable coupling or mounting device, such as a spring clip 16 suitably configured for coupling or attachment to an art device, such as a trackway 18 of a vertical type venetian blind system, to be adjustably supported outwardly of a wall, not shown; and fastening means, such as threaded fasteners or screw devices 20 and 22, for fastening spring clip 16 to extension arm 14 and for fastening the extension arm to bracket member 12, respectively.

Figure 2:
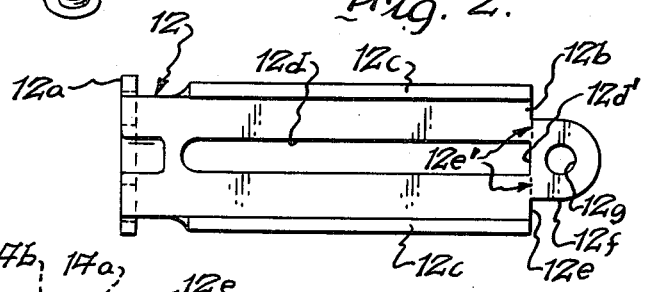
FIG. 2 is a plan view of the fixed bracket member.

Bracket member 12 is of angled construction having a vertically disposed wall mounting portion **12*a* and a horizontally extending support portion 12*b* perpendicularly oriented with respect to portion 12*a*. Support portion 12*b* is a generally planar rectangular member having a pair of up-turned side or guide rails 12*c* extending from the side edges thereof, an adjustment slot 12*d* extending lengthwise of the support portion intermediate the side rails from adjacent mounting portion 12*a* to the transverse outer end or edge 12*e* of support portion 12*b*, and an integrally formed break-away tab 12*f* projecting beyond edge 12*e* and serving to normally close the outer end of slot 12*d*. Preferably, the outer end 12*d*' of slot 12*d* is squared off and disposed in alignment with outer end or edge 12*e*. Tab 12*f* has a thickness corresponding to that of support portion 12*b* intermediate side rails 12*c* and is formed with a centrally located mounting aperture 12*g* substantially centered on the longitudinal axis of slot 12*d*. The fabrication of bracket member 12 is such that tab 12*f* bridges across slot 12*d* and may be broken off from the outer end of support portion 12*b*, by bending or vertically flexing the areas designated as 12*e*'. If required, score or otherwide defined lines of weakness may be provided, as indicated in broken line FIGS. 1 and 2** to facilitate the breaking off of the tab.

Extension arm 14 is preferably in the form of a flat, generally rectangular plate, which is essentially lengthwise coextensive with support member **12*b* and transversely sized to fit within the confines of side rails 12*c* for slidable motion lengthwise of slot 12*d*. A plurality of threaded mounting apertures 14*a*–14*d* pass through extension arm 14 and are disposed for vertical alignment with slot 12*d* and with tab aperture 12*g*, depending upon the position of extension arm with respect to support member 12*b***.

Spring clip 16 is similar in construction to that conventionally employed for mounting of a trackway of the type illustrated in the drawings on a wall mounted bracket in that it includes a planar central portion **16*a* provided with a mounting opening 16*b*; a spring finger 16*c* depending downwardly and forwardly from the rear of portion 16*a* and then downwardly and rearwardly to define a shoulder 16*d* and a gripping lip 16*e* depending downwardly and rearwardly from the front of portion 16*a*. The arrangement is such as to permit the trackway 18 to be releasably secured or snap-fit between the shoulder 16*d* and the lip 16*e* in a manner similar to that disclosed for instance in prior U.S. Pat. Nos. 3,299,943 and 4,079,770. The specific construction of the coupling elements of the spring clip 16, namely, shoulder 16***d* and lip 16*e*, form no part of the present invention and may be variously formed depending on the construction of the device with which they are to engage.

Figure 3:
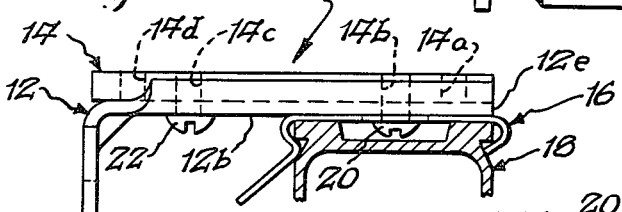
FIG. 3 is an elevational view of the bracket assembly depicting the same supporting a trackway in its minimum position of extension or spacing from a wall.

In the minimum position of extension of arm 14 depicted in FIG. 3, the tab 12*f* is simply broken off and screw device 20 passed upwardly successively through opening 16*b* and slot 12*d* for receipt within an aligned one of mounting apertures, namely, aperture 14*b*, whereby to clamp support portion 12*b* intermediate spring clip 16 and extension arm 14. If desired, screw device 22 may be passed upwardly through the rearwardly disposed end of slot 12*d* for receipt within aperture 14*c* for the purpose of clamping together the rearwardly disposed ends of support portion 12*b* and extension arm 14. In this minimum position, the tab is not required and is removed from support portion 12*b*, thereby permitting the trackway 18 to assume a flush position with respect to the outer ends of both support portion 12*b* and arm 14 without having the tab projecting forwardly therebeyond.

Figure 4:
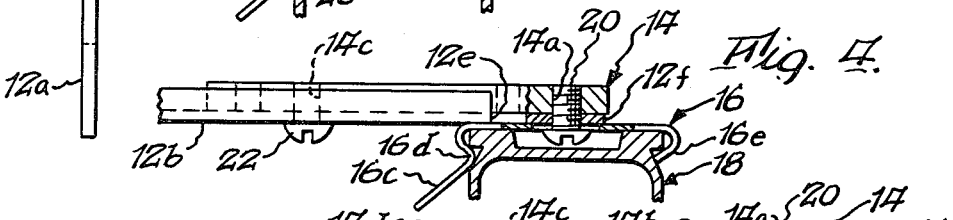
FIG. 4 is a partial fragmentary view similar to FIG. 3, but illustrating the assembly and the trackway in an intermediate position of extension.

In an intermediate or mid-range position of extension, depicted as by example in FIG. 4, tab 12*f* is broken off and inserted between the upper surface of spring clip 16 and the lower surface of arm 14 with its opening 12*g* in alignment with the forward most apertures 14*a*, and screw device 20 passed upwardly through openings 16*b* and 12*g* for receipt within such aligned aperture 14*a* to clamp tab 12*f* intermediate the spring clip and the arm. The rearwardly disposed ends of support portion 12*b* and arm 14 are again clamped together by screw device 22. For such mid-range positions, the rear of clip portion 16*a* necessarily bears against a forward portion of the lower surface of support portion 12*b*, and in the absence of tab 12*f* would, upon tightening of screw device 20, be caused to cant or tilt upwardly and rearwardly until it makes contact with the forwardly disposed lower edge of arm 14. The resultant canted or tilted position of spring clip 16 and thus trackway 18 would be unsightly and likely result in malfunction of the blinds supported by the trackway. Thus, tab 12*f* serves as a spacer, during mid-range positions of arm 14, and cooperates with support portion 12*b* to maintain clip 16 and trackway 18 level to insure proper functioning of the blind system.

Figure 5:
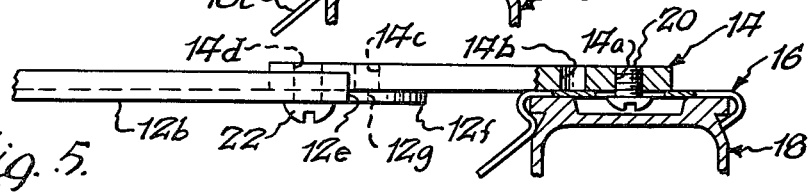
FIG. 5 is a view similar to FIG. 4, but illustrating the assembly and the trackway in its maximum position of extension.

When arm 14 has been extended sufficiently such that spring clip 16 no longer engages with support portion 12*b*, tab 12*f* need no longer be employed as a spacer for purposes of preventing canting of the spring clip, and if desired, simply discarded with the spring device being clamped directly to the arm as shown in FIG. 5. However, for positions of arm 14 beyond such positions wherein overlapping engagement would occur between spring clip 16 and support portion 12*b* or tab 12*f*, if not broken off and removed, it is preferable to retain tab 12*f* integral with the support portion for the purpose of increasing the rigidity thereof. This becomes increasingly more important as arm 14 is moved towards its position of maximum extension depicted in FIG. 5, wherein screw device 20 must be received within aperture 14*d* and disposed closely adjacent to the outer or forward end of slot 12*d*, and cantilever forces imposed by the weight of the blind system reaches its maximum value. Moreover, in this regard, it will be noted that the retaining tab 12*f* as an integral part of support portion 12*b* under conditions of maximum extension, effectively prevents spreading apart of the support portion, i.e., widening of the outer end of slot 12*d*, which might otherwise result in "pulling through" or unseating of screw device 22 under certain loading conditions.

By again referring to the drawings, it will be understood that aperture 14*c* may be dispensed with for bracket constructions, wherein slot 12*d* extends fully to the rear of support portion 12*b* and there remains sufficient clearance between the head of screw device 22 and mounting portion 12*a* to permit manipulation of such screw device. In such constructions, screw device 22 would be received within aperture 14*d* for all adjusted positions of arm 14.

The sizing of the several elements comprising assembly 10, as well as the spacing between threaded apertures 14*a*, will depend upon the size of the trackway to be mounted and the desired extent of adjustment thereof relative to a supporting wall. However, as by way of example, for a trackway having a nominal widthwise dimension of one inch, the present assembly may be sized to provide for full range adjustment of the "spacing" between a support wall and the center line of the trackway of from two inches to four and one-half inches. For such a case, tab 12*f* may extend on the order of about one-half inch beyond the outer end of support portion 12*b*, such that it would desirably be broken off for spacings under about two and one-half inches, used as a spacer for spacings between about two and one-half inches and three and one-half inches, and retained as an integral part of the support portion for spacings exceeding about three and one-half inches.

Moreover, it will be apparent that the assembly of the present invention may be used in supporting venetian blind systems, other than vertical blinds having a trackway of the type depicted in the drawings, as well as drapery rod or channel supports. For such alternative uses, it would merely be necessary to employ a coupling device whose coupling element or elements may be conventional and determined by the type of art device to be supported relative to a wall. Thus, the terms "trackway" and "spring clip", as used in the appended claims are meant to include other known art devices and coupling devices therefor, and accordingly not limit the intended scope of such claims to bracket assemblies of the type used for mounting vertical type, venetian blinds.

What is claimed is:

1. A bracket assembly for adjustably mounting a device in spaced relation to a wall, said assembly comprising:

a fixed bracket member having a support portion formed with an elongated slot and a break-away tab extending from an outer end of said support portion and closing one end of said slot, said tab having a mounting aperture;

an adjustable extension arm mounted on said support portion for adjustment lengthwise of said slot, said arm being elongated and having a plurality of mounting apertures spaced apart lengthwise thereof and disposed for vertical alignment with a longitudinal axis of said slot;

a coupling device having a mounting opening therethrough and means for coupling same to said device; and fastener means including means received within said slot and mounting apertures for releasably securing said arm in all adjusted positions thereof to said support portion and means selectively received within said mounting opening, said slot and said mounting apertures and within said mounting opening. said mounting aperture and said mounting apertures and within said mounting opening and said mounting apertures for selectively securing said coupling device to said arm in all said adjusted positions thereof.

2. The bracket assembly according to claim 1, wherein said tab is selectively broken away and serves as a spacer between said arm and said coupling device in positions of said arm whereat said coupling device engages with said support portion and said mounting opening is disposed outwardly beyond said outer end of said support portion.

3. The bracket assembly according to claim 1 or 2, wherein said support portion is substantially planar and has a pair of side rails along the longitudinal side edges thereof for confining said arm to sliding movement between said side rails and lengthwise of said slot and said fixed bracket member includes a mounting portion extending perpendicularly from an inner end of said support portion for securing the same to a wall, said coupling device is a spring clip, and said device is a trackway for vertical venetian blinds.

4. A bracket assembly for adjustably mounting a device in spaced relation to a wall, said assembly comprising in combination:

a stationary bracket member having an elongated support portion formed with a slot, said slot extending lengthwise of and terminating in alignment with an outer end of said support portion;

a tab integrally joined to said outer end of said support portion in areas on opposite sides of said slot to extend in a coplanar relationship with said support portion outwardly beyond said outer end for bridging across said slot and closing an end thereof aligned with said outer end, said tab being characterized in that it may be selectively broken away from said support portion to open said end of said slot by flexing imparted to said areas by manipulation of said tab;

an extension arm essentially lengthwise coextensive with said support portion and mounted thereon for adjustment lengthwise of said slot, said arm having threaded apertures spaced lengthwise thereof for alignment with a longitudinal axis of said slot;

a coupling device having a planar portion formed with a mounting opening and means for coupling same to said device; and a pair of screw devices, a first of said screw devices extending through said slot for receipt within said threaded apertures for releasably and adjustably clamping said arm to said support portion in selected adjusted positions spaced lengthwise of said slot, and a second of said screw devices extending through said mounting opening for receipt within said threaded apertures for releasably and adjustably clamping said planar portion of said coupling device selectively against said support portion, against both said support portion and said tab and against said arm.

5. The assembly according to claim 4, wherein said tab is formed with a mounting aperture sized to freely receive said second of said screw devices, and said mounting aperture is disposed in alignment with said longitudinal axis while said tab is joined to said support portion.

6. The assembly according to claim 5, wherein said arm is a generally rectangular flat plate, said support portion is substantially planar and has a pair of side rails along longitudinally extending side edges thereof for confining said arm for sliding movement between said side rails and lengthwise of said slot, said bracket member additionally includes a wall engaging mounting portion extending normal to said support portion adjacent an inner end thereof remote from said outer end, said device is a trackway for a vertical venetian blind and said means of said coupling device snap-fit engages with said trackway.

7. A bracket assembly for adjustably mounting a device in spaced relationship to a wall, said assembly comprising in combination:

a stationary bracket member having an elongated support portion formed with a pair of upturned guide rails extending along opposite side edges thereof and a slot extending lengthwise of said support portion intermediate said guide rails, said slot having an outer end terminating in alignment with a transversely extending outer edge of said support portion;

a tab integrally joined to said support portion in areas on opposite sides of said outer end of said slot to extend in a coplanar relationship with said support portion outwardly beyond said outer edge for bridging across said slot and closing said outer end thereof, said tab being characterized in that it may be selectively broken away from said support portion to open said outer end of said slot by flexing imparted to said areas by manipulation of said tab;

an extension arm supported on said support portion intermediate said guide rails and for adjustment lengthwise of said slot, said arm having a plurality of mounting apertures spaced lengthwise thereof for vertical alignment with a longitudinal axis of said slot;

a coupling device having a mounting opening and means for coupling said coupling device to said device; and a pair of fastener means, a first of said fastener means extending through said slot and said mounting apertures for releasably and adjustably clamping said arm to said support portion in selected adjusted positions spaced lengthwise of said slot, and a second of said fastener means extending through said mounting opening and said mounting apertures for releasably and adjustably clamping said coupling device selectively against said support portion, against both said support portion and said tab and against said arm depending upon the adjusted position of said arm.

8. The assembly according to claim 7, wherein said tab is formed with a mounting aperture sized to freely receive said second of said fastener means, and said mounting aperture is disposed in alignment with said longitudinal axis while said tab is joined to said support portion.

* * * * *